US006530470B2

(12) United States Patent
Roundy

(10) Patent No.: US 6,530,470 B2
(45) Date of Patent: Mar. 11, 2003

(54) HOLDING BOX FOR PAINT-APPLYING ROLLER WET WITH PAINT

(75) Inventor: Bruce W. Roundy, Salt Lake City, UT (US)

(73) Assignee: Brush Saver, Inc., Salt Lake City, UT (US)

( * ) Notice: Subject to any disclaimer, the term of this patent is extended or adjusted under 35 U.S.C. 154(b) by 0 days.

(21) Appl. No.: 09/844,937

(22) Filed: Apr. 27, 2001

(65) Prior Publication Data

US 2002/0157978 A1 Oct. 31, 2002

(51) Int. Cl.[7] ..... A45D 44/18; B65D 81/24; B65D 51/09; A47L 13/56

(52) U.S. Cl. ..... 206/15.3; 15/257.06; 206/209; 220/839

(58) Field of Search ..... 206/209, 15.2, 206/15.3, 361; 15/248.2, 257.06; 220/839, 837

(56) References Cited

U.S. PATENT DOCUMENTS

| | | | | |
|---|---|---|---|---|
| 1,869,753 A | | 8/1932 | Kamm | |
| 3,149,747 A | | 9/1964 | Burgess | |
| 3,511,433 A | | 5/1970 | Andrews et al. | |
| 3,712,748 A | | 1/1973 | Wilmans | |
| 3,828,389 A | | 8/1974 | Heisler | |
| 4,077,515 A | | 3/1978 | Shoberg | |
| 4,445,250 A | | 5/1984 | Seidl | |
| 4,547,926 A | | 10/1985 | Kern | |
| 4,667,361 A | | 5/1987 | Wolcott et al. | |
| 4,691,838 A | | 9/1987 | Graham et al. | |
| 4,700,830 A | | 10/1987 | O'Brien | |
| 4,802,576 A | | 2/1989 | Kern | |
| 5,016,777 A | * | 5/1991 | Marvin | 220/839 |
| 5,539,950 A | | 7/1996 | Zar et al. | |
| 5,540,363 A | | 7/1996 | Wilson | |
| 5,645,164 A | * | 7/1997 | Hocking | 206/209 |
| 5,709,301 A | * | 1/1998 | Couch et al. | 206/361 |
| 5,797,410 A | * | 8/1998 | Gates | 206/15.3 |
| 5,966,902 A | * | 10/1999 | Korycki | 206/209 |

FOREIGN PATENT DOCUMENTS

GB 2218969 A * 11/1989 ..... 206/15.3

* cited by examiner

*Primary Examiner*—Bryon P. Gehman
(74) *Attorney, Agent, or Firm*—Mallinckrodt & Mallinckrodt; Robert R. Mallinckrodt

(57) ABSTRACT

A paint roller filled with wet paint may be stored for a period of time, such a over lunch break or overnight, or for longer times, and still be useable for painting, by substantially sealing the roller while attached to the usual handle-attached, paint applicator to which the roller is mounted, in an elongate box which covers the roller and through an opening in which a portion of the paint applicator extends. The portion of the paint applicator extending through the opening is substantially sealed by deformable paint solvent absorbent material in the opening to which a small amount of paint solvent, such as water, is added to maintain a solvent rich atmosphere in the box to help maintain the paint on the roller in wet, usable condition.

15 Claims, 3 Drawing Sheets

HOLDING BOX FOR PAINT-APPLYING ROLLER WET WITH PAINT

BACKGROUND OF THE INVENTION

1. Field

Figure 1:
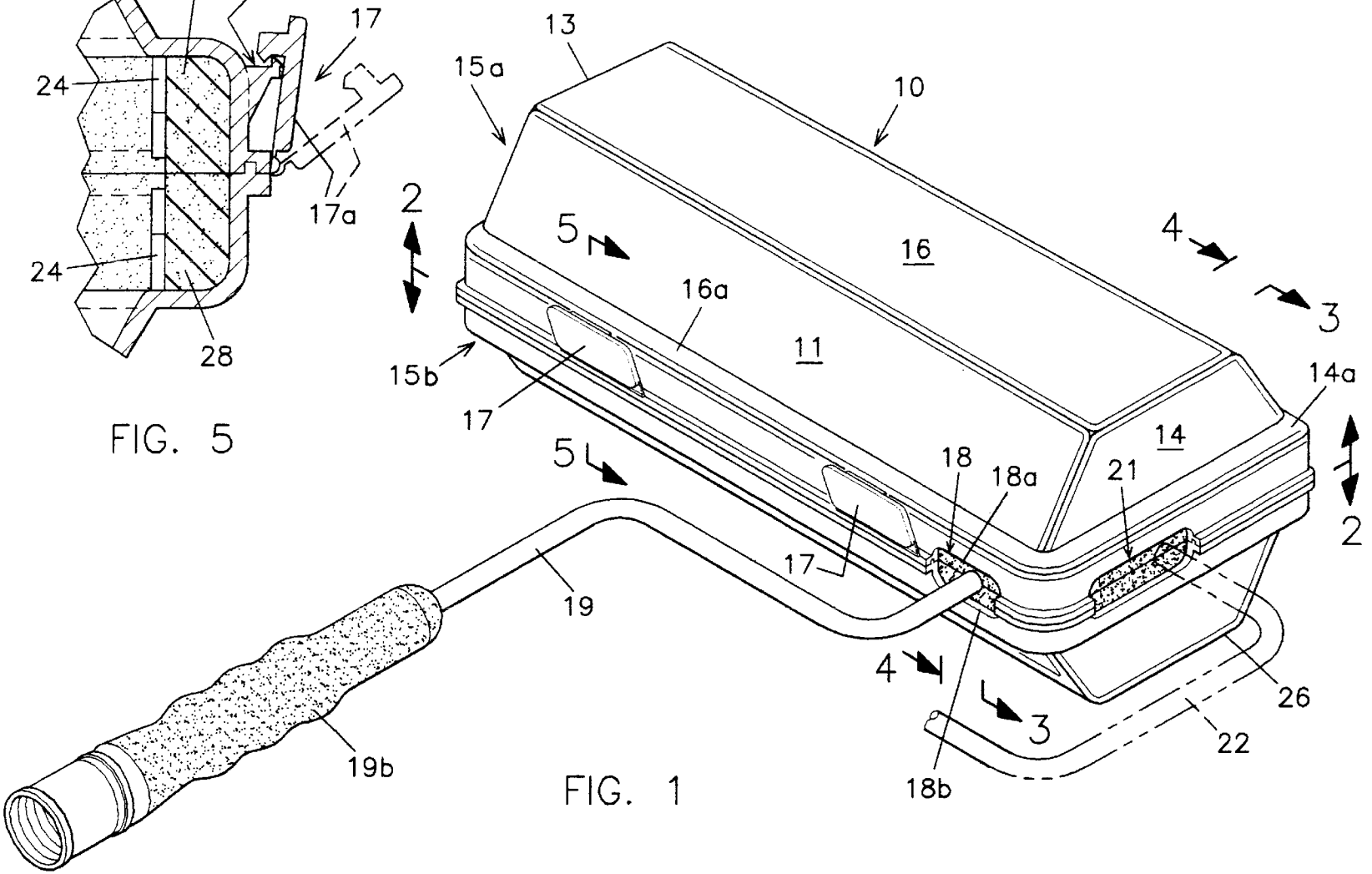

This invention is concerned with boxes or box-like containers for holding paint rollers that are wet with paint.

2. State of the Art

Paint-applying rollers have long been known and used for rapidly painting expansive surface areas, such as walls and ceilings, in place of the usual paint brushes. Such rollers are not normally rinsed in a paint solvent at the completion of a day's work, as are paint brushes, since they are more difficult to handle. They are usually thrown away and replaced by new ones for the following day's work.

Several years ago a container was developed by Ronald W. Wilson for holding a wet paint brush so that it could remain wet with paint from time to time in an atmosphere of a paint solvent. U.S. Pat. No. 5,540,363 was issued for this on Jul. 30, 1996. The product made according to that patent is commercially available and works well in actual practice, and I wondered whether a somewhat similar approach might work for the usual paint-applying rollers. However, the varying sizes and varying applicator mountings of such rollers posed difficulties that I found were not easily overcome. Even though a patent on a container for a paint-applying roller (U.S. Pat. No. 4,802,576) had issued to a German inventor, Ingo Kern, in Berlin, Germany, on Feb. 7, 1989, for a wet paint roller storage container, such container included a roll of foil for wrapping the roller. The patent teaches the use of a broad and flat container for storing a paint-applying roller, the container being made to rest horizontally on a receiving surface and being hermetically sealed when closed about a received paint-applying roller wet with paint. It receives the entire applicator, handle and all, and includes an attached additional holder for a roll of foil for wrapping the wet roller. This is inconvenient and in spite of the Wilson patent, no persons skilled in the art concerned had solved the problems which I confronted in adapting the teachings of the Wilson paint brush storage patent to the storage of paint-applying rollers.

U.S. Pat. No 5,539,950 directed to a protective housing for roller covers issued the same day as the Wilson patent. That patent teaches a cover for wet paint rollers having a seal around the periphery of the cover and a channel seal, a small and curved aperture which which conforms to the shape of the shaft in order to seal the liquid coating material and fumes within the body, is provided to seal around the applicator shaft extending therethrough. However, the varying sizes of rollers and, particularly, the varying sizes and configurations of roller applicator shafts that need to be accomodated by a roller cover, would require different covers for different shaft sizes in order to provide the channel seal described by the patent.

There remains a need for a more universally applicable roller cover that maintains the wet roller stored therein in usable condition for long periods of time.

OBJECTIVE OF THE INVENTION

A principal objective in the making of the present invention was to provide a convenient box, preferably made of plastic, that would enable effective storage of a usual paint-applying roller, wet with paint, on a temporary basis much as does the box-like container of the aforesaid Wilson U.S. Pat. No. 5,540,363 for a wet paint brush.

SUMMARY OF THE INVENTION

According to the invention, an elongate box may be closed and substantially sealed around a paint roller filled with wet paint, while still mounted on the usual handle-provided, paint applicator. A portion of the handle-provided, paint applicator extends through an opening in the box and through deformable paint solvent absorbent material, such as plastic foam material,positioned in the opening which substantially seals the opening around the portion of the applicator extending therethrough. Paint solvent, generally water, is added to the solvent absorbent material to maintain a solvent rich (with water, moist) atmosphere in the box.

A feature of the present invention in meeting its objective is the provision of at least one outlet opening in an upstanding wall of a horizontally positionable box for passing therethrough a portion of the usual handle-provided applicator on which a paint applying roller is mounted, so that the handle extends outside the box.

An optional feature is the provision of two such openings, one in an end wall of the box and one preferably in an adjacent portion of a longitudinal side wall of the box for selectively accommodating either the usual manually operated or the usual electrically powered unit.

Another optional feature is the provision, interiorly of the box, for supporting the roller at a level above the floor of the box, and, optionally, a similar provision for supporting the roller relative to the ceiling of the box if and when the box is inadvertently turned upside down before its intended horizontal placement on a supporting surface.

Thus, the invention involves, basically, the foregoing feature in a box or box-like container for temporarily storing a manually operated and/or an electrically powered roller wet with paint.

THE DRAWINGS

Shown in the accompanying drawings is a preferred embodiment constituting the best form of the invention as presently contemplated.

Figure 5:
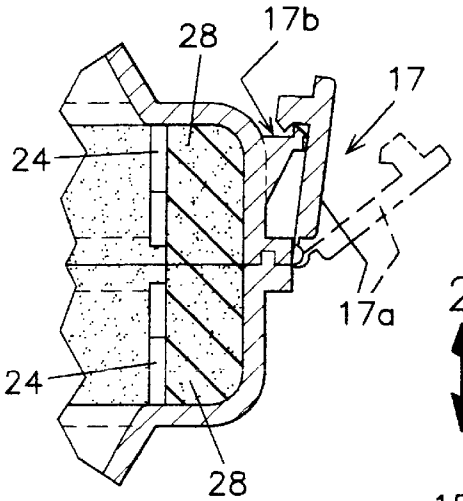
Figure 2:
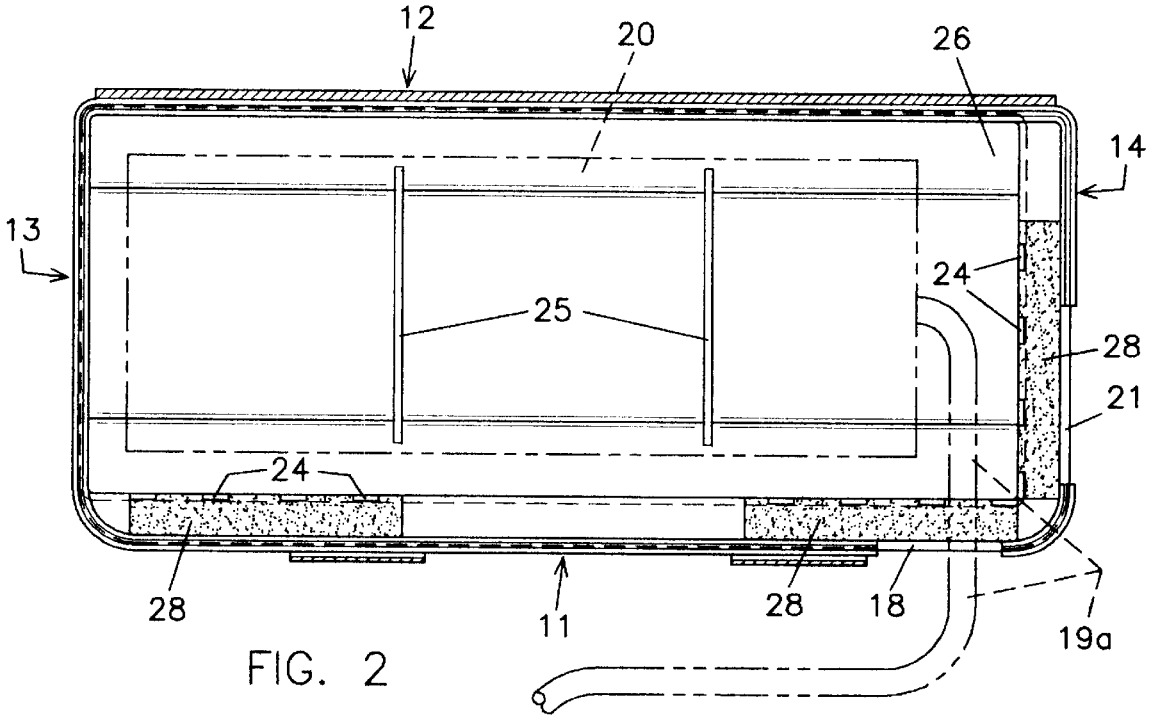
Figure 3:
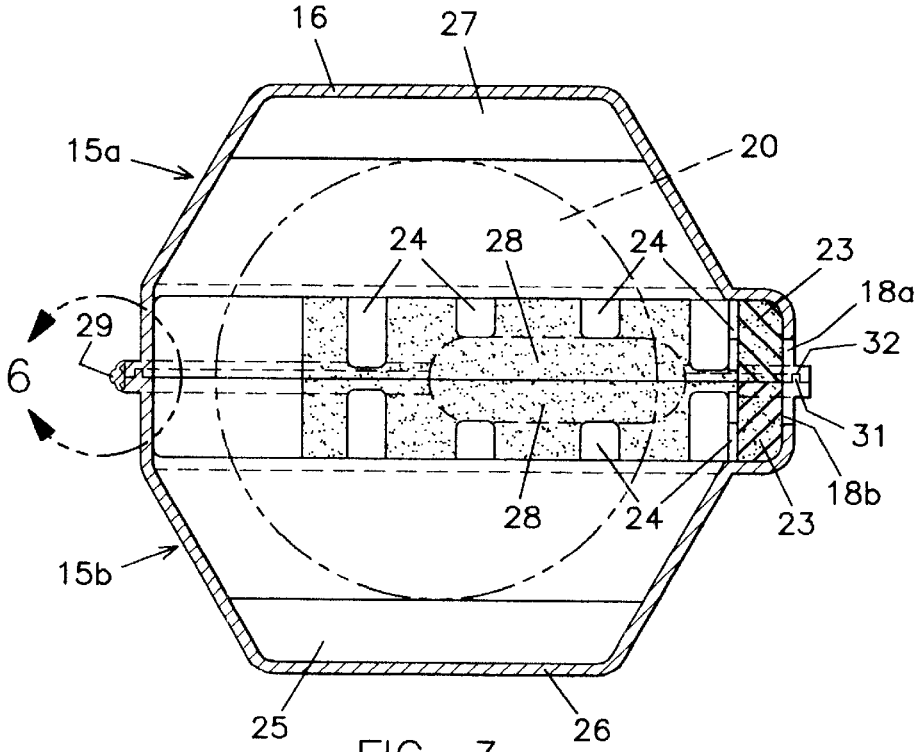
Figure 6:
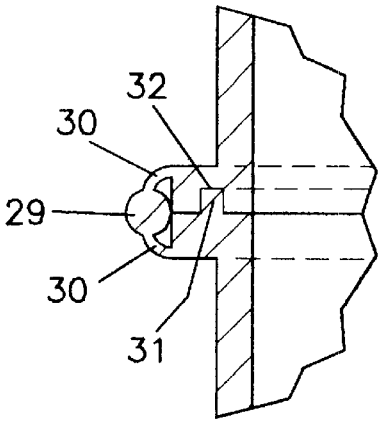
Figure 7:
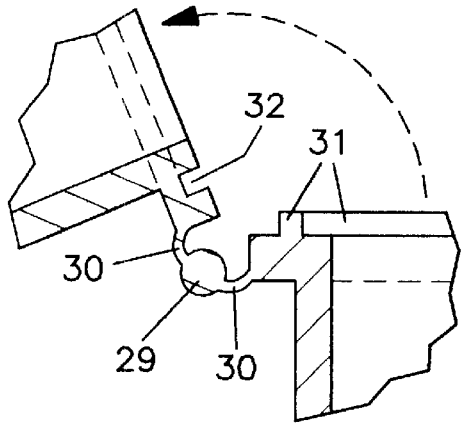
Figure 4:
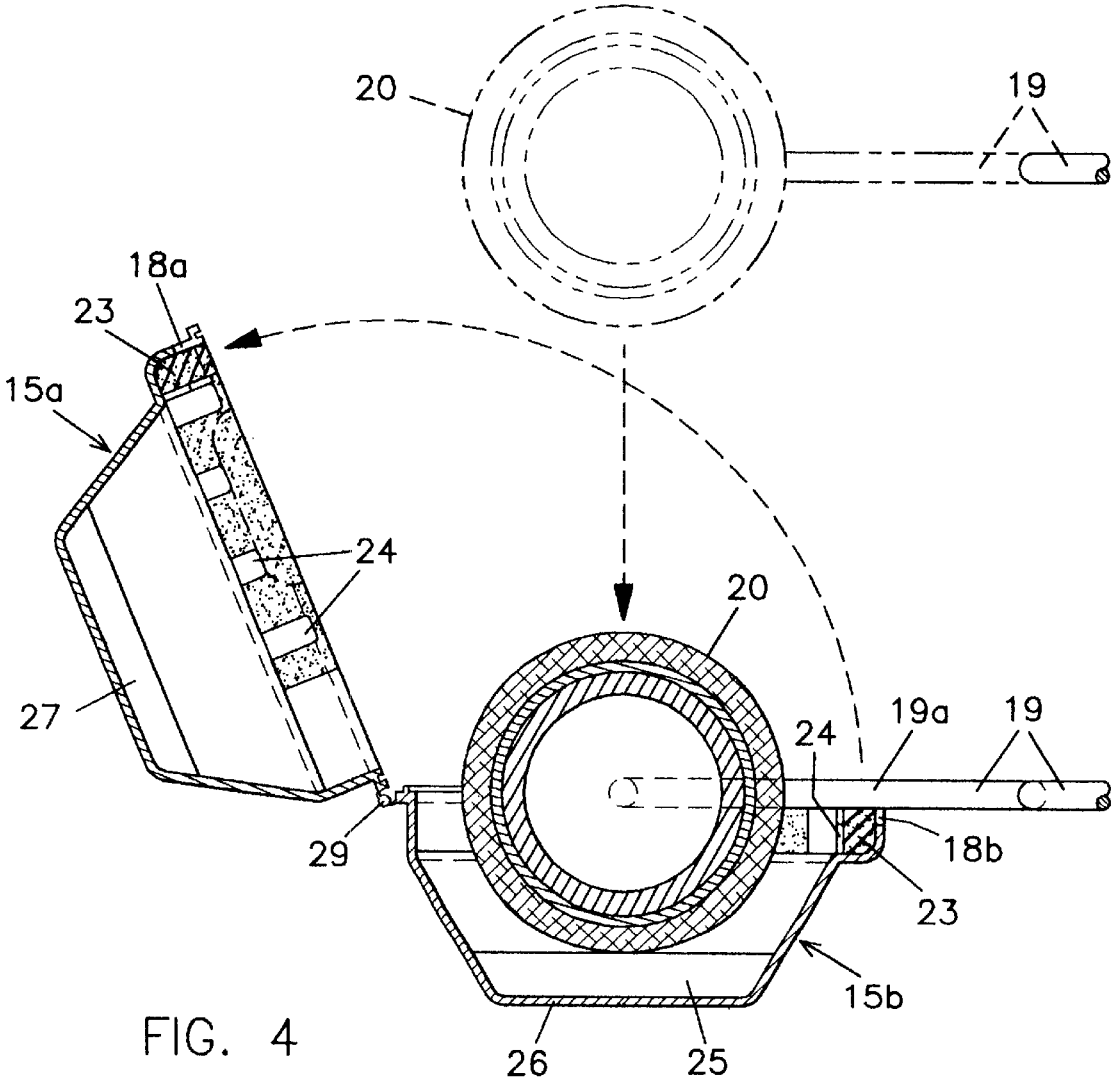

In the drawings:

FIG. 1 is a perspective view looking toward the front of a box of the invention as closed about a usual, manually operated painting roller mounted on a handle-provided rod applicator for the roller and utilizing the appropriate one of two openings preferably provided, the other opening being for the applicator rod of a usual powered unit, which is shown fragmentally by broken lines;

FIG. 2, a horizontal section taken on the line 2—2 of FIG. 1, with the roller and manual applicator indicated by broken lines, the latter being indicated only fragmentarily;

FIG. 3, a transverse, vertical section taken on the line 3—3 of FIG. 1, with the roller again being indicated by broken lines;

FIG. 4, a transverse, vertical section taken on the line 4—4 of FIG. 1, but with the box open and the roller shown in full lines and the applicator shown fragmentarily by both full and broken lines, there being also a broken line version with an arrow indicating how the roller is inserted in the open box and another arrow indicating how the box is hinged open;

FIG. 5, a fragmentary, vertical section taken on the line 5—5 of FIG. 1, showing in broken lines how the latch structure is opened;

FIG. 6, a fragmentary portion of the vertical section of FIG. 3 as partially encircled by the arrowheaded and broken line 6 of FIG. 3; and FIG. 7, the fragmentary portion shown in FIG. 6, but with the box open as indicated by the applied arrow of FIG. 7 and the double arrows of FIG. 1.

DETAILED DESCRIPTION OF THE INVENTION AS ILLUSTRATED

As shown in the drawings, the box of the invention for storing a paint-applying roller wet with paint is preferably elongate longitudinally and made for resting substantially horizontally on a supporting surface. It is sized for receiving a paint-applying roller mounted on the usual rod like handle-provided, paint applicator. Thus, the illustrated box 10 has opposite, longitudinally extending, top and bottom, horizontal walls designated 16 and 26, respectively, upstanding, mutually opposite, front and back longitudinal side walls 11 and 12, respectively; and upstanding, mutually opposite, end walls 13 and 14, respectively. Each of the upstanding side and end walls 11–14 is split apart along its length, with hinge structure joining mutually adjoining edge portions of one or the other of the longitudinal side walls, 11 and 12, here the back wall 12, so the upper box section 15*a* of the two sections (collectively designated 15), with its upper wall 16, can be swung backwardly along a hinge line, here shown as bead 29 with flexible hinge portions 30 and 31 extending from the edge rim portions of walls 12 as shown in FIGS. 4 and 7, the other longitudinal side wall 12 and both end walls 13 and 14 separating along their respective lines of split as the box is opened.

As illustrated, the front longitudinal side wall 11 and the end wall 14 are preferably not substantially planar upwardly and downwardly as are back wall 12 and end wall 13, but have rectangular portions 11*a* and 14*a* protruding outwardly to provide for holding absorbent sealing material around applicator rod-receiving openings as hereinafter explained.

As shown in FIGS. 1, 3 and 5, the split, longitudinal side wall 11 at the front of the box is provided with latching structure 17 having cooperative latching members 17*a* and 17*b*, FIG. 5, for holding the box sections 15*a* and 15*b* together when the box is closed.

For receiving a portion 19*a* of the usual handle-provided, paint applicator (generally a rod) in the open condition of the box and for passing such paint applicator outwardly of the box through a side wall, here longitudinal side wall 11, of the box in its closed condition, side wall 11 is provided with matching notches 18*a* and 18*b*, FIG. 1, in the mating upper and lower, split portions 11*a* and 11*b*, respectively, to provide a receiving opening 18, when the box is closed, through which such portion 19*a* of the usual handle-provided, paint applicator 19 mounting the usual manually operated paint-applying roller 20, passes. This opening 18 is located in the unhinged, longitudinal wall of the box adjacent to a side wall of the box and preferably in the front wall adjoining one end of the mutually spaced latching structure 17 as clearly shown in FIG. 1, the applicator rod 19 being shown here as substantially perpendicular to the longitudinal extension of the box and provided with an attached handle 19*b*.

An opening 21, FIG. 1, generally similar to opening 18, is provided in an end wall of the box, here, as shown, preferably in the end wall 14 of the box adjacent to front wall 11, for receiving and passing a portion of the applicator 22 (again, generally a rod) of a usual power operated, paint-applying roller.

As in the Wilson paint brush container of U.S. Pat. No. 5,540,363, strips 23, see particularly FIG. 4, of preferably a closed cell, plastic foam material, are applied across the rod-receiving notches of openings 18 and 21, respectively, being held in place by suitable holding members 24 interiorly of the box, and serving to seal as a gasket the respective openings and preferably also to absorb and to gradually vaporize into the interior atmosphere of the closed box, a suitable paint solvent, such as water for a latex paint as usually used with paint rollers.

It has been found in accordance with the invention, that in order to avoid the formation of a flat spot along the roller where it rests on the bottom of a cover, that a paint-applying roller must be supported interiorly of the box above the bottom of the box. Thus, interior supporting structure for the roller is preferably provided. This support is preferably in the form of a number of relatively thin and low interior supporting wall members rising from the interior surface of the bottom wall of the box, i.e. from the floor of the box, and extending transversely of the length of the box, such as the roller-supporting wall members 25, FIGS. 2 and 3, although effective interior support for the roller at a level above the interior surface of the bottom wall 26 of the box could be provided otherwise, as by any suitable supporting structure interiorly of the box. The supporting structure shown will cause line indentations in the roller surface where it is supported by the transverse support walls, but such lines do not cause the painting problem that a flat spot along the entire roller length does.

To maintain the roller in a preferred position free of the inner surfaces of both lower and upper walls in case the box is inadvertently placed horizontally, with its top rather than its bottom resting on a horizontal supporting surface, upper supporting wall members 25-1, FIGS. 3 and 4, may be provided extending downwardly from the ceiling surface of the top wall 16 of the box.

Moreover, additional strips 28, FIG. 2, preferably of the same solvent absorbent material as that across the openings 18 and 24, may be provided along selected portions of the parting rims of the hinged top and bottom box sections 15*a* and 15*b*, as well as similar holding members 24 therefor.

It is preferred that box 10 be substantially sealed. For more effective sealing of the box 10, the wall edge portions may be provided, as shown in FIGS. 3–7, with interengaging ridges 31 and receiving grooves 32. With the box 15 closed, and latched in closed position, the interengaging ridges and grooves form a substantially air tight seal and openings 18 and 21 are substantially sealed by material 28.

It has been found that with use of the box of the invention, rollers wet with paint may be placed in the box, water added to material 28, and the roller stored in useable condition for extended time periods of at least several days or weeks. The box will generally be used to store such rollers over lunch or overnight where the roller will continue to be used on the same job.

With both the side wall and end wall openings 18 and 21, respectively, a wide variety of roller holding handle-provided, paint applicators, both manual and power operated, can be stored in the box of the invention. The normal three-sixteenth to one-half inch applicator rods of manual applicators, and the up to three-quarter inch applicator rods of the power applicators are easily accommodated by the material 28, such as closed cell plastic foam material, in openings 18 and 21. The size of box 10 is generally big enough to hold up to twelve inch long rollers with up to about a three inch nap, although various size boxes can-be provided.

While two clips 17 have been shown on the front wall 11 of the box as the latching structure, more than two clips may be used and clips may be provided at other locations such as adjacent opening 21 in end wall 14, if needed to hold the box tightly closed.

Whereas there is here illustrated a preferred form of the presently contemplated best mode of the invention, it should be realized other forms may be adapted without departing from the teachings thereof.

I claim:

1. An elongate box made to be supported longitudinally and substantially horizontally for temporarily storing a paint-applying roller wet with paint, comprising mutually opposite, lower and upper, elongate, longitudinal walls; mutually opposite, upstanding, longitudinal side walls; and mutually opposite, upstanding end walls; said walls defining therebetween interior space for receiving, longitudinally, a paint-applying roller mounted on a handle-provided, paint applicator and being wet with paint; an opening in one of the upstanding walls of the box adapted for receiving and passing therethrough a portion of the roller-mounting, handle-provided paint applicator when the paint-applying roller is received in the interior space, so the handle of the applicator will be external to the box, said opening being larger than the portion of the roller-mounting, handle-provided paint applicator which passes therethrough when the paint-applying roller is received in the interior space; solvent absorbing material positioned in the box to receive and hold solvent therein and release solvent vapors into the box to help prevent drying of the paint on the roller, said solvent absorbing material being deformable and positioned at least in the opening and adapted to close the opening and to deform around the portion of the roller-mounting, handle-provided paint applicator when passing therethrough.

2. A box in accordance with claim 1, wherein the opening is disposed in a longitudinal side wall of the box; and wherein there is another opening formed in an end wall of the box; said openings being available selectively for receiving a portion of the roller-mounting, handle-provided, paint applicator of either a manually operated roller or a powered roller, said another opening being closed with deformable solvent absorbent material.

3. A box in accordance with claim 2, wherein the opening in the longitudinal side wall of the box is located adjacent the end wall provided with the opening.

4. A box in accordance with claim 3, wherein the lower, elongate, longitudinal wall forms a floor for the box, additionally including roller-supporting structure rising from the wall forming the floor of the box to support a paint-applying roller thereon above the floor.

5. A box in accordance with claim 4, wherein the roller-supporting structure comprises mutually spaced wall members rising from the floor of the box and supporting the roller above the floor of the box.

6. A box in accordance with claim 5, wherein the roller-supporting structure comprises a series of walls extending transversely of the interior of the box from side wall to side wall thereof.

7. A box in accordance with claim 6, wherein the roller-supporting wall members are relatively thin and low and extend across the interior of the box substantially perpendicularly to the side walls thereof.

8. A box in accordance with claim 7, wherein the upper, elongate, longitudinal wall forms a ceiling for the box, additionally including roller-supporting structure extending downwardly from the wall forming the ceiling of the box for supporting the roller if the box is inadvertently turned upside down.

9. A box in accordance with claim 8, wherein the roller-supporting structure extending downwardly from the ceiling comprises mutually spaced wall members extending downwardly from the ceiling of the box.

10. A box in accordance with claim 9, wherein the roller-supporting structure comprises a series of walls extending transversely of the interior of the box from side wall to side wall thereof.

11. A box in accordance with claim 10, wherein the roller-supporting wall members are relatively thin and short and extend across the interior of the box substantially perpendicularly to the side walls thereof.

12. A box in accordance with claim 11, wherein the box is split into upper and lower, oppositely openable, longitudinal sections; additionally including hinge structure joining together adjoining rims of an upstanding longitudinal wall of the box, the applicator-receiving opening being provided between the adjoining rims of an upstanding wall of the box other than the hinged upstanding longitudinal wall.

13. A box in accordance with claim 12, wherein the said hinge structure includes a substantially cylindrical longitudinal member held by respective flexible hinge arms to the said rims.

14. A box in accordance with claim 13, wherein the said hinge structure includes confronting interengaging ridges and grooves on said adjoining rims, respectively, for sealing the line of hinge when the box is in closed position.

15. A box in accordance with claim 14, wherein the adjoining rims of upstanding longitudinal walls of the box include interengaging ridges and grooves on respective adjoining rims for sealing said adjoining rims in the closed position of the box.

* * * * *